United States Patent [19]

Graver et al.

[11] 4,057,503

[45] Nov. 8, 1977

[54] CONCENTRATES FOR IMPARTING TEMPORARY SOIL RELEASE RESINS IN FABRICS DURING LAUNDERING

[75] Inventors: Clair Warren Graver, King of Prussia; Clarence Edward Carwheel, Philadelphia; Charles Joseph Bunczk, Norristown, all of Pa.

[73] Assignee: Pennwalt Corporation, Philadelphia, Pa.

[21] Appl. No.: 623,700

[22] Filed: Oct. 20, 1975

[51] Int. Cl.[2] ..... D06M 13/20

[52] U.S. Cl. ..... 252/8.7; 8/137; 428/272

[58] Field of Search ..... 252/8.7; 8/137; 428/272, 274

[56] References Cited

U.S. PATENT DOCUMENTS

| | | | |
|---|---|---|---|
| 2,740,759 | 4/1956 | Maeder et al. | 252/8.7 |
| 3,686,025 | 8/1972 | Morton | 428/274 |
| 3,782,898 | 1/1974 | Mandell | 8/137 |
| 3,909,476 | 9/1975 | Mandell | 8/137 |
| 3,965,014 | 6/1976 | Giordano et al. | 252/8.7 |

*Primary Examiner*—William E. Schulz

*Attorney, Agent, or Firm*—R. G. Danehower

[57] ABSTRACT

Compositions of matter are disclosed in which acrylic resins for temporary impregnation of textile fabrics are combined with a laundry sour in aqueous or granular concentrates. These compositions are then introduced to the wash wheel in the last stage of a laundering operation immediately prior to drying the textile fabric. The acrylic resins impart soil release and stain removal properties to the fabrics. Fabric finishing agents may also be included in the compositions.

6 Claims, No Drawings

CONCENTRATES FOR IMPARTING TEMPORARY SOIL RELEASE RESINS IN FABRICS DURING LAUNDERING

BRIEF DESCRIPTION OF THE INVENTION

Synthetic fabrics have created problems in laundering especially when stained with oil and grease. A recent patent, U.S. Pat. No. 3,782,898 entitled "Temporary Soil Release Resins Applied to Fabrics in Laundering" teaches the use of acrylic resins for the impregnation of fabrics in the final step of a laundering operation to provide good soil release and stain removal. This process is repeated with each subsequent washing thereby keeping the fabrics in serviceable condition. This patent describes a process which requires a sour to be added, either with the resin or before the resin in the final step of the laundering process. The sour is necessary in order to lower the pH within the range of about 4 to about 6.5 to remove strong alkali from the fabrics and in addition it is the best pH range for making the most efficient use of the resins in removing soil and stains.

Some laundries prefer not to sour or do not have the capability of adding a sour and soil release product separately. The advantages of a combined soil release-sour product is readily apparent when one considers laundries that use liquid systems. These laundries are set up on a programmed electronic system whereby liquid laundry supplies are fed on demand to washwheels. The soil release with built-in sour product allows these laundries the versatility of adding the product neat or in stock solution eliminating the need for a separate sour stock tank.

We have discovered that laundry sours and acrylic soil release resins can be formulated as aqueous and granular concentrates by the use of particular coupling and dispersing agents. Optionally, fabric finishing agents can be added to the concentrates. It will be apparent that these concentrates will be used in the final stage of the laundry process and that no water rinse will be used on the fabric after this treatment. The coupling and dispersing agent insures the uniform suspension of the acrylic resins in both the aqueous concentrate and in the aqueous use solutions.

The acrylic resins which are removably impregnated into fabrics for soil release and stain release purposes are homopolymers and copolymers of acrylic acid and methacrylic acid. The copolymers are formed by copolymerizing acrylic or methacrylic acid with alkyl esters of acrylic acid or methacrylic acid.

The laundry sours which are used in the sour-soil release resin concentrate are the silicofluorides such as sodium, ammonium, magnesium, and zinc; mineral acids such as phosphoric and hydrochloric acid and organic acids such as acetic, hydroxy acetic, formic and oxalic acid.

The coupling and dispersing agents which enable us to stabilize a suspension of acrylic resin in the aqueous concentrate and in the aqueous use solution are one or more members selected from the group consisting of alkyl aryl sulfonates, alkyl sulfonates, alkyl sulfates, condensed naphthalene sulfonates, sulfo derivatives of succinates, taurates and alkyl ether sulfates.

Our aqueous concentrates will contain about 3 to about 10% by weight of acrylic resins while the laundry sour will be present at about 3 to 10% by weight. The organic coupling and dispersing agent will be present at about 0.5 to about 3% by weight. If a fabric finishing agent is desired in the aqueous concentrate it will be present at a concentration of about 0.0 to 1% by weight. Water constitutes the balance at about 93.5 to 76% weight.

The fabric finishing agents which can be combined with the souracrylic resin aqueous concentrate are fabric brighteners, fabric softeners, blueing, flame retardants, bacteriastats and mildewstats. We found during the course of our work that effective amounts of sizing agents could not be coupled into the aqueous concentrate. However, they can be combined with acrylic resins, sours and finishing agents in dry particulate formulations. The soil release compositions are formulated as aqueous concentrates or dry granular concentrates which are applied direct to the commercial laundry wheel in the last stage of the laundry process and diluted therein with water to the proper use concentrations. The resins are generally applied to the fabrics at a concentration of about ¼ to 3 parts by weight resin per 5000 parts by weight of laundry souring solution.

For those customers requiring a combined sour, resin impregnation and sizing application in the last stage of the laundering operation and since we were unable to effectively couple large amounts of sizing agents into our liquid concentrate, we discovered that these materials could only be combined in a dry particulate formulation using a water-free acrylic soil release resin, a granular laundry sour, sizing agent and dispersing agent.

For the dry particulate concentrate the acrylic soil release resins will be the same as for the liquid concentrate except that the water used for dispersing and emulsifying the resins has been removed. The laundry sours and dispersing agents are also the same as used in the aqueous concentrate.

The sizing materials will be one or more members selected from the group consisting of natural starches such as corn, rice and potato; and synthetic sizing agents such as polyvinyl alcohol, cellulose derivatives and polyvinyl acetate. Sizing is used at a concentration of about ½ to 1 pound per 100 pounds of dry fabrics in the laundering process.

In the dry particulate concentrate the laundry sour will constitute about 20 to 35 percent, the acrylic soil release resin will constitute about 10 to 20 percent, the fabric finishing agent, if present, will constitute from about 0 to 2 percent, the coupling and dispersing agent will constitute about 1 to 5 percent and the sizing will constitute the balance from about 69 to 38 percent, all percentages being by weight.

DETAILED DESCRIPTION OF INVENTION

Soil Release Resins

The resins suitable for practicing this invention are all derived from homopolymers and copolymers of acrylic acid and methacrylic acid. The homopolymers which form suitable soil release resins are polyacrylic acid and polymethacrylic acid. Either homopolymer or mixtures of the homopolymers provide satisfactory soil release resins for textile fabrics in our process.

In addition to the homopolymers described above various copolymers formed by copolymerizing acrylic or methacrylic acid with alkyl esters of acrylic acid or methacrylic acid are satisfactory soil release resins. In these copolymers the mole ratio of acrylic acid or methacrylic acid to the alkyl esters of acrylic acid or methacrylic acid must be at least 1 to 1 in order to provide water solubility or water dispersiblity of the copolymer. Any ratio of acid to ester greater than 1 to 1 including the acid homopolymers provide suitable soil release resins. The alkyl substituents are $C_1$ through $C_4$ groups. Mixtures of these copolymers are also satisfactory temporary soil release resins.

Esters suitable for copolymerizing with acrylic acid or methacrylic acid to provide satisfactory temporary soil release are methyl acrylate, ethyl acrylate, n-propyl acrylate, isopropyl acrylate, n-butyl acrylate, isobutyl acrylate, methyl methacrylate, ethyl methacrylate, n-propyl methacrylate, isopropyl methacrylate, n-butyl methacrylate and isobutyl methacrylate.

In addition to the copolymers described above which are useful temporary soil release resins, mixtures of the homopolymers with the various copolymers described above are particularly useful as temporary soil release resins. Any ratio of mixtures of the homopolymers or mixtures of homopolymers and copolymers described above provides suitable temporary soil release resins for practicing our invention.

A preferred temporary soil release system comprises mixtures of the homopolymer of acrylic acid and copolymer formed from ethyl acrylate and methacrylic acid. The above homopolymers and copolymers and their mixtures described above which provide satisfactory temporary soil release resins for fabrics in our new laundering compositions are hereinafter referred to in the specification and claims as acrylic resins.

The sours useful in our composition are one or more of the acids or acid salts selected from the group consisting of acetic, hydroxyacetic, formic and oxalic acids, zinc, sodium, ammonium and magnesium fluosilicates, ammonium chloride and sodium and ammonium acid fluorides. The preceeding sours are useful either as liquid or granular concentrates. In addition, phosphoric acid and hydrofluoric acid, which are liquids, can be used in the aqueous concentrate. The souring operation is accomplished at a pH within the range of about 4 to 6.5 and the amount of sour required will depend on the extent of residual alkalinity carried over in the fabrics from the alkaline detergent washing cycle.

Coupling — Dispersing Agents

The coupling and dispersing agents which are used in our compositions are required to keep the materials suspended in the use solutions and in the aqueous concentrate. The coupling and dispersing agents can be one or more members of the group consisting of alkyl aryl sulfonates where the alkyl group ranges from $C_3$ to $C_{12}$ and the aryl group is benzene, naphthalene and diphenyl; alkyl sulfonates where the alkyl group ranges from $C_{10}$ to $C_{12}$; alkyl sulfates where the alkyl group ranges from $C_8$ to $C_{12}$; acids and salts of condensed formaldehyde-naphthalene sulfonates where the salts may be sodium, potassium and ammonium; salts of sulfonated alkylsuccinic acid where the alkyl group ranges from $C_4$ to $C_8$ and where the salts are sodium, ammonium and potassium; taurates where the acyl group is oleoyl and coco and the alkyl group is methyl; and sodium and potassium salts of alkylether sulfates where the alkyl group may be $C_{12}$ or $C_{13}$.

Suitable alkylaryl sulfonates are dodecylbenzene sulfonate sold under the trademark NACCONOL 90F, butyl naphthalene sulfonate sold under the trademark EMKAL BNS, isopropyl naphthalene sulfonate sold under the trademark AEROSOL OS and octylphenyl sodium sulfonate sold under the trademark TRITON X200. A typical alkyl sulfonate is sodium alpha decene sulfonate sold under the trademark OLEFIN sulfonate. Suitable alkyl sulfates are sodium octyl sulfate sold under the trademark DUPANOL 80 and sodium lauryl sulfate sold under the trademark AVIROL 101. Suitable salts of condensed formaldehyde-naphthalene sulfonate are sodium formaldehydenaphthalene sulfonate sold under the trademark TAMOL SN, ammonium formaldehyde-naphthalene sulfonate sold under the trademark LOMAR PWA, formaldehyde-naphthalene sulfonic acid sold under the trademark LOMAR NCO. A suitable salt of sulfonated alkylsuccinic acid is dihexyl sulfosuccinate sold under the trademark MONOWET MM80. Suitable taurates are sodium N-methyl-N-oleoyl-taurate sold under the trademark IGEPON T-77 and sodium N-coconut-acid-N-methyl taurate sold under the trademark IGEPON TC-42. Suitable alkyl ether sulfates are sodium lauryl ether sulfate sold under the trademark AVIROL -100-E and sodium tridecyl ether sulfate sold under the trademark AVIROL-113.

The coupling and dispersing agent will constitute from about 0.5 to 3 percent of our aqueous concentrate and about 1 to 5 percent of our dry particulate concentrate. Additional amounts can be used without obtaining any additional benefits.

Fabric Finishing Agents

One or more compatible fabric finishing agents may be incorporated in the liquid or granular concentrates along with the soil release acrylic resins and the laundry sour. The term fabric finishing agent includes fabric brighteners, fabric softeners, mildewstats, bacteriastats, flame retarding agents and blueing.

In our aqueous concentrate the acrylic resin will constitute about 3 to 10 percent resin solids, preferably about 6 percent resin solids. The souring agent will constitute from about 3 to 10 percent of the concentrate while 6 percent is preferred. The coupling agent will be present within the range of about one-half to 3 percent. If a fabric finishing agent is desired, it will constitute from about 0 to one percent. Preferably, the fabric finishing agent will be present at 0.001 percent. All percentages are by weight. The concentrations are summarized in Table I below.

TABLE I

| | Aqueous Concentrate | | |
|---|---|---|---|
| | Percent by Weight | | |
| Material | Minimum | Maximum | Preferred |
| Acrylic Resin (100%) | 3 | 10 | 6 |
| Laundry Sour | 3 | 10 | 6 |
| Coupling and Dispersing Agent | 0.5 | 3 | 1 |
| Fabric Finishing Agent | 0 | 1 | 0.001 |
| Water (balance) | 93.5 | 76 | 86.999 |

The amount of aqueous concentrate added to water to prepare the dispersions used by the laundry operator will depend on the concentration of the resin that the operator desires to use. If a 10% by weight resin concentrate is used the operator will add about 16,566 parts of water to 100 parts of aqueous concentrate to obtain 3 parts of acrylic resin per 5000 parts by weight of treating solution. At ¼ part by weigh resin to 5000 parts by weight laundering treating solution there will be added about 200,000 parts by weight water for each 100 parts by weight of the 10% resin aqueous concentrate. If a 3% by weight resin concentrate is used there will be required about 5000 parts by weight of water to make a concentration of 3 parts resin per 5000 parts of laundering solution and 60,000 parts of water to make a concentration of ¼ resin per 5000 parts of treating solution.

The granular concentrate will contain from about 10 to 20 percent resin while a preferred concentration is 15 percent. The souring agent will constitute from about 20 to 35 percent while the preferred concentration is 25 percent. The coupling and dispersing agent will constitute from about 1 to 5 percent with the preferred concentration at 1 percent. The fabric finishing agent may optionally be present from about zero to 2 percent with a preferred concentration at 1 percent. Sizing will constitute the balance of the composition. The percentages are all percent by weight. The concentrations are summarized in Table II below.

TABLE II

| | Granular Concentrate | | |
|---|---|---|---|
| | Percent by Weight | | |
| Material | Minimum | Maximum | Preferred |
| Acrylic Resin (100%) | 10 | 20 | 15 |
| Laundry Sour | 20 | 35 | 25 |
| Coupling and Dispersing Agent | 1 | 5 | 1 |
| Fabric Finishing Agent | 0 | 2 | 1 |
| Sizing (balance) | 69 | 38 | 58 |

Finishing Solution

The finishing solution is the last operation in the laundering process. Both the sour and the soil release resin may be combined in this operation in order to avoid separate laundry operations. The resin impregnation must be the last operation to prevent loss of the resins by a subsequent laundering involving immersion in or rinsing of the fabrics with water which would wash away most of the resin. The finishing solution will also contain any fabric finishing agent and/or sizing material if desired which also must be applied in the last stage of the laundering operation and not thereafter rinsed with water. The clothes are usually immersed in the finishing solution for about 3 to 10 minutes, preferably within about 5 to 8 minutes. Temperature of the finishing solution will be within the range of about 70° to 180° F., preferably within the range of about 95° to 180° F. In commercial laundering machines about 350 pounds of water are used for each 100 pounds of clothes on a dry basis.

The amount of granular concentrate added to water to prepare the dispersions used by the laundry operator will depend on the concentration of the resin in the concentrate and the treating concentration of the resin desired by the laundry operator in his finishing solution. If the granular concentrate is at 10% acrylic resin content then from 200,000 down to 16,567 parts by weight of water will be added to 100 parts by weight of the concentrate to give resin concentrations of ¼to 3 parts per 5000 parts of treating solution. If a 20% acrylic resin concentrate is used, then each 100 parts of the concentrate will be added to a range of 400,000 down to 33,233 parts of water to give the ¼ to 3 parts by weight resin for 5000 parts by weight finishing solution.

The concentration of the fabric finishing agents if present will vary from laundry to laundry. Generally, blueing is applied to white goods at the rate of 1/32 oz. per 100 pounds of white goods. Fabric brighteners are applied at the rate of 1 oz. per 100 pounds of dry clothes. Fabric softeners are applied at the rate of 1½ to 2 oz. per 100 pounds of dry fabrics. Mildewstats and bacteriastats are applied at 1 to 4 oz. per 100 pounds of dry fabrics, preferably at 1.5 oz. Sizing agents are applied at the rate of 4 to 16 oz. per 100 pounds of dry clothes, preferably at 8 oz. per 100 pounds.

Drying

The souring operation combined with resin impregnation and/or other fabric finishing treatment including sizing takes place within about 3 to 10 minutes, preferably within 5 to 8 minutes. Following the treatment period in souring solution containing the acrylic resin, the textile fabrics are separated from the treating solution and are then dried. Separation of the resin-sour solution is usually accomplished by centrifugal extraction or by hydraulic pressing.

There is generally retained on the fabric after separation of the souring solution or other fabric finishing solution, about an equal weight of the treating solution. For every 100 pounds of dry clothes treated there will be about 100 pounds of sour solution. When the resin concentration in the sour is one part resin per 5000 parts by weight of souring solution, then 100 pounds of clothes will have retained 1/50 of a pound of resin or 0.02% resin. When the resin concentration in the souring solution is ¼ part resin to 5000 parts by weight of souring solution, the resin retention on the fabrics is about 0.005% by weight. At ½ part resin per 5000 parts by weight of souring solution, the resin impregnation on the fabrics after drying will be about 0.01% by weight. At 2½ parts resin per 5000 parts of souring solution the resin impregnation on the fabrics will be about 0.05% by weight. A preferred impregnation on the dry fabrics is about 0.01 to 0.02% by weight.

The wet resin impregnated fabrics are dried at temperatures varying from room temperature to about 350° F. Drying is accomplished in conventional air dryers for clothes or by ironing or by pressing. Ironing temperatures are generally about 350° F. Somewhat lower temperatures are generally used in the air dryers and satisfactory drying can be accomplished with air temperatures as low as about 70° F. or room temperature. The water is more rapidly removed at higher temperatures and temperatures of 150° to 350° F. are preferred.

The best mode of practicing our invention may be understood from a consideration of the following examples:

EXAMPLE 1

In a Milnor Washer, Model No. 600-CWM-5 of 35 pounds dry clothes capacity was placed 24 pounds of polyester-cotton rags and 1 pound of 10 inches square test swatches of white shirting, 65/35 polyester cotton finished with a durable press resin. The washer was filled with water to the 16 gallon level and 0.25 pound of a commercial all-in-one laundry detergent was added. The water temperature was 150° F. After 10 minutes of agitation, the system was drained, refilled, and 0.125 pound of detergent was added. It was agitated 5 minutes at 150° F and then drained. There were three 30 gallon water rinses, each one at 150° F., 130° F., 120° F. After the three rinses, water was added to the 16 gallon level at 110° F. At this time there was added one-half pint of an aqueous resin-sour solution containing 8.0% by weight of a 25% by weight polyacrylic acid solution, 10.0% by weight of a 20% by weight solution of a copolymer of ethyl acrylate and methacrylic acid in the ratio of 2.7 mols methacrylic acid to 1 mol of ethyl acrylate, 6.0% by weight of ammonium silicofluoride and 2.0% by weight of sodium formaldehyde-naphthalene sulfonate. One-half pint of resin-sour solution provides 5.0 grams of polyacrylic acid, 9.5 grams of the copolymer, 14.9 grams of ammonium silicofluoride sour and 5 grams of sodium formaldehyde-naphthalene sulfonate. The system was agitated for 8 minutes, drained and centrifugely extracted for 1 minute. The polyester-cotton rags and test swatches were then dried by ironing for 15 seconds at 350° F.

The test swatches were soiled by placing on them at two separate spots, 5 drops of refined mineral oil and 5 drops of used motor oil. These spots were then blotted and allowed to age for a minimum of one-half hour. The staining and rating procedure was the standard method of the American Association of Textile Chemists and Colorists, Test 130-1969.

Control swatches made from fabric identical to the test swatches were laundered in exactly the same manner as the foregoing procedure with the exception that no aqueous resin-sour solution was added but instead, the ammonium silicofluoride was added alone in the souring operation.

The control and the test swatches were then subjected to at least one additional cycle of laundering, treatment with the combined product of polymer, copolymer and sour solution, drying, and staining. The subsequent stains being placed at different locations on the test swatches. The test series was carried out with resin-sour addition in each sour step, and the control series was carried out with no resin addition at any time.

Following each ironing, the color intensity of the spot was evaluated. Rating of 5 represents complete disappearance of the spot.

The results after three cycles are given in Table III.

TABLE III

| | Spots Applied | | | |
|---|---|---|---|---|
| | End of 1st Cycle | | End of 2nd Cycle | |
| | Mineral Oil | Motor Oil | Mineral Oil | Motor Oil |
| Test Swatches | 3.5+ | 3.0 | 3.5+ | 3.5 |
| Control | 3.5 | 1.5+ | 3.5 | 1.0 |

After the first laundering following treatment with resin and staining, the stains on the treated fabric were seen to be lighter than the stains on the untreated fabric. That is, the laundering stage following resin treatment was more effective in removing the stains.

EXAMPLE 2

The test and control experiments of Example 1 were carried out varying the temperature of the solution in which the soil release polymer was applied to the testile. These experiments are recorded in Table IV.

TABLE IV (Grading at the completion of three cycles of spots applied at the end of the first cycle then subjected to two full cycles of treatment.)

| | TEMPERATURE OF SOURING AND APPLICATION SOLUTION | | | | | |
|---|---|---|---|---|---|---|
| | 75° F. | | 110° F. | | 180° F. | |
| | Mineral Oil | Motor Oil | Mineral Oil | Motor Oil | Mineral Oil | Motor Oil |
| Test Swatches | 3.5+ | 2.0 | 3.5+ | 3.5 | 4.0 | 3.0+ |
| Control | 4.0 | 1.0+ | 3.5 | 1.0 | 4.0 | 1.0+ |

It is seen that even at an application solution temperature as low as 75° F. there is some beneficial effect due to the polymer treatment. A more pronounced effect is obtained at higher application temperatures.

EXAMPLE 3

Using the composition and procedure of Example 1, after the one-half pint of resin/sour/dispersant solution was added to the finishing solution, four ounces of commercially available starch were added to the finishing solution and the clothes processed and tested as in Example 1 except that the clothes were dried by ironing at 150° F. The results after 2 successive treatments are given in Table V.

TABLE V

| | SPOTS APPLIED | | | |
|---|---|---|---|---|
| | End of 1st Cycle | | End of 2nd Cycle | |
| | Mineral Oil | Motor Oil | Mineral Oil | Motor Oil |
| Test Swatches | 3.5+ | 3.0 | 3.5 | 3.0 |
| Control | 3.5 | 2.0 | 3.5 | 1.0+ |

EXAMPLE 4

The experiment of Example 1 was carried out except that there was added to the finishing solution one-half ounce of a 32.7 percent by weight solution of a quarternary ammonium type fabric softener prior to the addition of the acrylic resin-sour to the solution. The softener agent was dimethyl difatty ammonium chloride.

The comparative test and control swatches are shown in Table VI.

TABLE VI

| | Spots Applied | | | |
|---|---|---|---|---|
| | End of 1st Cycle | | End of 2nd Cycle | |
| | Mineral Oil | Motor Oil | Mineral Oil | Motor Oil |
| Test Swatches | 4.0 | 2.5+ | 4.0 | 3.0+ |
| Control | 3.5+ | 2.0 | 3.5 | 1.5 |

EXAMPLE 5

The procedure of Example 1 was carried out except that the one-half pint of aqueous resin/sour solution contained 8.0% by weight at a 25% by weight polyacrylic acid solution, 19.0% by weight of a 20% by weight solution of copolymer of ethyl acrylate and methacrylic acid in the ratio of 2.7 mols methacrylic acid to 1 mol of ethyl acrylate, 8.0% by weight of 85% orthophosphoric acid and 1% by weight sodium formaldehyde naphthalene sulfonate dispersant. One half pint of resin/sour solution provides 5.0 grams of polyacrylic acid, 9.5 grams of the copolymer, 16.9 grams of orthophosphoric acid and 2.5 grams of dispersant. Following are the results after 3 cycles of resin impregnation treatments with comparative controls in Table VII.

TABLE VII

| | Spots Applied | | | |
|---|---|---|---|---|
| | End of 1st Cycle | | End of 2nd Cycle | |
| | Mineral Oil | Motor Oil | Mineral Oil | Motor Oil |
| Test Swatches | 3.5+ | 1.5+ | 3.5+ | 2.0+ |
| Control | 3.5+ | 1.5 | 3.5 | 1.0 |

EXAMPLE 6

The procedure of Example 1 was carried out except that the one-half pint of aqueous resin/sour solution contained 8.0% by weight of a 25% by weight polyacrylic acid solution, 19.0% by weight of a 20% by weight solution of a copolymer of ethyl acrylate and methacrylic acid in the ratio of 2.7 mols methacrylic acid to 1 mole of ethyl acrylate, 10.0% by weight of glacial acetic acid and 1% by weight dispersant. One-half pint of resin/sour solution provides 5.0 grams of polyacrylic acid, 9.5 grams of the copolymer, 24.8 grams of glacial acetic acid and 2.5 grams of dispersant. Following are the results after 3 cycles with comparative controls in Table VIII.

TABLE VIII

| | Spots Applied | | | |
|---|---|---|---|---|
| | End of 1st Cycle | | End of 2nd Cycle | |
| | Mineral Oil | Motor Oil | Mineral Oil | Motor Oil |
| Test Swatches | 4.0+ | 3.0+ | 4.0 | 3.0 |
| Control | 3.5 | 2.0 | 3.5+ | 1.5 |

Other organic acids such as formic acid, hydroxyacetic acid and oxalic acid may also be used successfully.

EXAMPLE 7

The procedure of Example 1 was carried out except that the one-half pint of aqueous resin/sour solution contained 8.0% by weight of a 25% by weight polyacrylic acid solution, 19.0% by weight of a 20% by weight solution of a copolymer of ethyl acrylate and methacrylic acid in the ratio of 2.7 mols methacrylic acid to 1 mol of ethyl acrylate, 12.0% by weight of a product containing 70% by weight hydrofluoric acid and 1% by weight TAMOL SN. One-half pint of resin/sour solution provides 5.0 grams of polyacrylic acid, 9.5 grams of the copolymer, 9.0 grams of hydrofluoric acid and 2.5 grams TAMOL SN. Following are the results after 3 cycles with comparative controls in TABLE IX.

TABLE IX

| | Spots Applied | | | |
|---|---|---|---|---|
| | End of 1st Cycle | | End of 2nd Cycle | |
| | Mineral Oil | Motor Oil | Mineral Oil | Motor Oil |
| Test Swatches | 4.0 | 2.5+ | 3.5+ | 2.5+ |
| Control | 3.5 | 1.5+ | 3.5 | 1.0 |

EXAMPLE 8

The procedure of Example 1 was carried out except that only one-eighth pint of the aqueous resin/sour solution of Example 1 was used. One-eighth pint of resins/sour solution provides 1.3 grams of polyacrylic acid, 2.4 grams of the copolymer, 5.0 grams of ammonium silicofluoride and 1.25 grams of dispersant.

The comparative test and control swatches are shown in Table X.

TABLE X

| | Spots Applied | | | |
|---|---|---|---|---|
| | End of 1st Cycle | | End of 2nd Cycle | |
| | Mineral Oil | Motor Oil | Mineral Oil | Motor Oil |
| Test Swatches | 3.5+ | 2.0+ | 3.5 | 1.5 |
| Control | 3.5+ | 2.0 | 3.5+ | 1.0 |

EXAMPLE 9

The stability of the aqueous concentrates was investigated by preparing the following concentrate and then to separate portions of the concentrate 3% by weight of the coupling and dispersing agents were added, stirred virgorously for about 30 seconds at room temperature and then each sample was placed in a glass storage bottle and held on a shelf at 100° F. Observations were made at weekly intervals for homogeniety. At the end of three months the concentrates were observed to be in stable single phase condition. At dilution of these concentrates in use concentrations of ¼ to 3 parts of resin per 5000 parts by weight of laundering solution in the laundry wheel excellent suspension of the acrylic resins and fabric finishing agents is obtained.

The coupling and dispersing agents found satisfactory were alkyl aryl sulfonates such as naphthalene sulfonate sold under the trademark AEROSOL OS, butyl naphthalene sulfonate sold under the trademark EMKAL BNS, dodecyl benzene sulfonate sold under the trademark NACCONAL 90F, sodium octylphenyl sulfonate sold under the trademark TRITON X200, sodium n-decyl diphenylether disulfonate sold under the trademark DOWFAC 3B2. An alkyl sulfonate found satisfactory was sodium alphadecene sulfonate sold under the trademark OLEFIN sulfonate. Satisfactory alkyl sulfates were sodium octyl sulfate sold under the trademark DUPANOL 80 and sodium lauryl sulfate sold under the trademark AVIROL 101.

Condensed formaldehyde-naphthalene sulfonates which tested satisfactory were sodium formaldehyde-naphthalene sulfonate sold under the trademark TAMOL SN, ammonium formaldehyde-naphthalene sulfonate sold under the trademark LOMAR PWA, formaldehyde-naphthalene sulfonic acid sold under the trademark LOMAR NCO. A satisfactory salt of sulfonated alkylsuccinic acid was dihexyl sulfosuccinate sold under the trademark MONOWET MM80. Satisfactory taurates tested were sodium N-methyl-N-oleoyl-taurate sold under the trademark IGEPON T-77 and sodium N-coconut-acid-N-methyl taurate sold under the trademark IGEPON TC-42. Suitable alkyl ether sulfates were sodium lauryl ether sulfate sold under the trademark AVIROL-100-E and sodium tridecyl ether sulfate sold under the trademark AVIROL-113. The above dispersants and couplers found satisfactory at 3% were also found to produce stable finishing solutions at 1% concentration.

EXAMPLE 10

The granular concentrate containing sodium silicofluoride - 25 percent, wheat based starch — 33 percent, sodium lauryl sulfate — 2 percent, acrylic copolymer of ethylacrylate and methacrylic acid - 15 percent and polyvinyl acetate —25 percent, all percentages being by weight was used at a concentration of 2 ounces per 25 pounds of dried clothes per 100 pounds of water as a finishing solution in the Milnor washer of Example 1. Following the test procedure described in Example 1, stain removal was observed on the test swatches as indicated in Table XI. The soil used was motor oil.

TABLE XI

| | End of 1st cycle | End of 2nd cycle | End of 3rd cycle |
|---|---|---|---|
| | Iron Drying at 350° F. | | |
| Test Swatch | 2.0 | 3.0 | 3.0+ |
| Control | 2.0+ | 2.0 | 2.5 |
| | Tumble Dry at 150° F. | | |
| Test Swatch | 2.0 | 2.5+ | 2.5+ |
| Control | 2.0+ | 2.0+ | 2.0 |
| | Air Dry at Room Temp. | | |
| Test Swatch | 2.5 | 2.5 | 2.0+ |
| Control | 2.0+ | 2.0+ | 2.0 |

We claim:

1. An acidic aqueous concentrate for dispersion in water for use as the final treatment of a laundering process at a pH of about 4 to about 6.5 to impart temporary soil and stain release properties to fabrics consisting essentially of: acrylic resin — 3 to 10 parts, laundry sour — 3 to 10 parts, coupling and dispersing agent selected from the group consisting of alkyl aryl sulfonates where the alkyl group ranges from $C_3$ to $C_{12}$ and the aryl group is benzene, naphthalene and diphenyl, alkyl sulfonates where the alkyl group ranges from $C_{10}$ to $C_{12}$; alkyl sulfates where the alkyl group ranges from $C_8$ to $C_{12}$; acids and salts of condensed formaldehyde-naphthalene sulfonates where the salts may be sodium, potassium and ammonium; salts of sulfonated alkylsuccinic acid where the alkyl group ranges from $C_4$ to $C_8$ and where the salts are sodium, ammonium and potassium; taurates where the acyl group is oleoyl and coco and the alkyl group is methyl; and sodium and potassium salts of alkylether sulfates where the alkyl group may be $C_{12}$ or $C_{13}$ — 0.5 to 3 parts; fabric finishing agent — 0 to 1 part and water — 93.5 to 76 parts, all parts being by weight.

2. The aqueous concentrate of claim 1 in which the fabric finishing agent is selected from the group consisting of brighteners, softeners, mildewstats, bacteriastats, flame retardants and blueing.

3. The aqueous concentrate of claim 1 in which the acrylic resin is selected from the group consisting of polyacrylic acid, polymethacrylic acid and copolymers of acrylic acid and methacrylic acid with alkyl esters of acrylic acid and methacrylic acid, said alkyl substituents having one to four carbon atoms and said copolymers having a mole ratio of acid to ester of at least 1 to 1.

4. The product obtained by removing water from the aqueous concentrate of claim 1.

5. The product of claim 4 having added thereto 38 to 69 parts by weight of sizing.

6. The product of claim 4 having added thereto a fabric finishing agent selected from the group consisting of brighteners, softeners, mildewstats, bacteriastats, flame retardants and blueing.

* * * * *